United States Patent [19]

Balassiano

[11] 3,960,455

[45] June 1, 1976

[54] FLEXIBLE DOUBLE BALL-POINT PEN

[76] Inventor: Max Balassiano, 98-01 67th Ave., Forest Hills, N.Y. 11374

[22] Filed: July 7, 1975

[21] Appl. No.: 593,323

[52] U.S. Cl. ..... 401/209; 401/214; 401/216

[51] Int. Cl.[2] ..... B43K 7/00; B43K 7/10

[58] Field of Search ..... 401/209, 214, 216

[56] References Cited

UNITED STATES PATENTS 2,879,586 3/1959 Fehling et al. ..... 401/216 X

FOREIGN PATENTS OR APPLICATIONS 1,151,093 8/1957 France ..... 401/214

1,245,566 10/1960 France ..... 401/216

1,068,152 10/1959 Germany ..... 401/216

*Primary Examiner*—Lawrence Charles

[57] ABSTRACT

A flexible double ball-point pen of special construction to permit writing characters and lines of different thicknesses and styles and changing the style of writing at will. The pen is provided with a flexible joint of compressible and expandable material responsive to the amount of pressure and direction of movement of the user's hand and also having a pair of ball-point balls in communication with an ink supply of any standard composition used in ball-point pens and held by a dimple formation in an ink-containing tube adjacent the writing end of the pen. The remainder of the ball-point pen may be of standard or conventional construction.

4 Claims, 8 Drawing Figures

FIG. 4
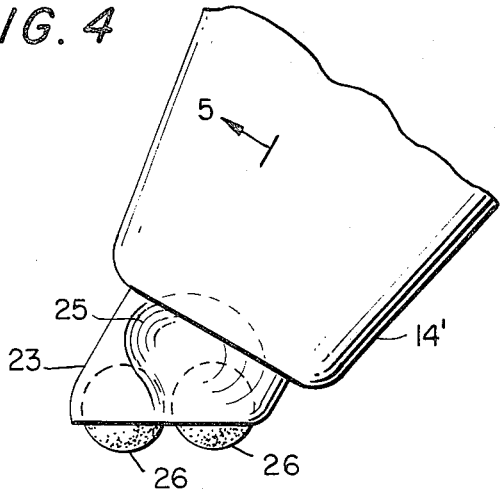
FIG. 6
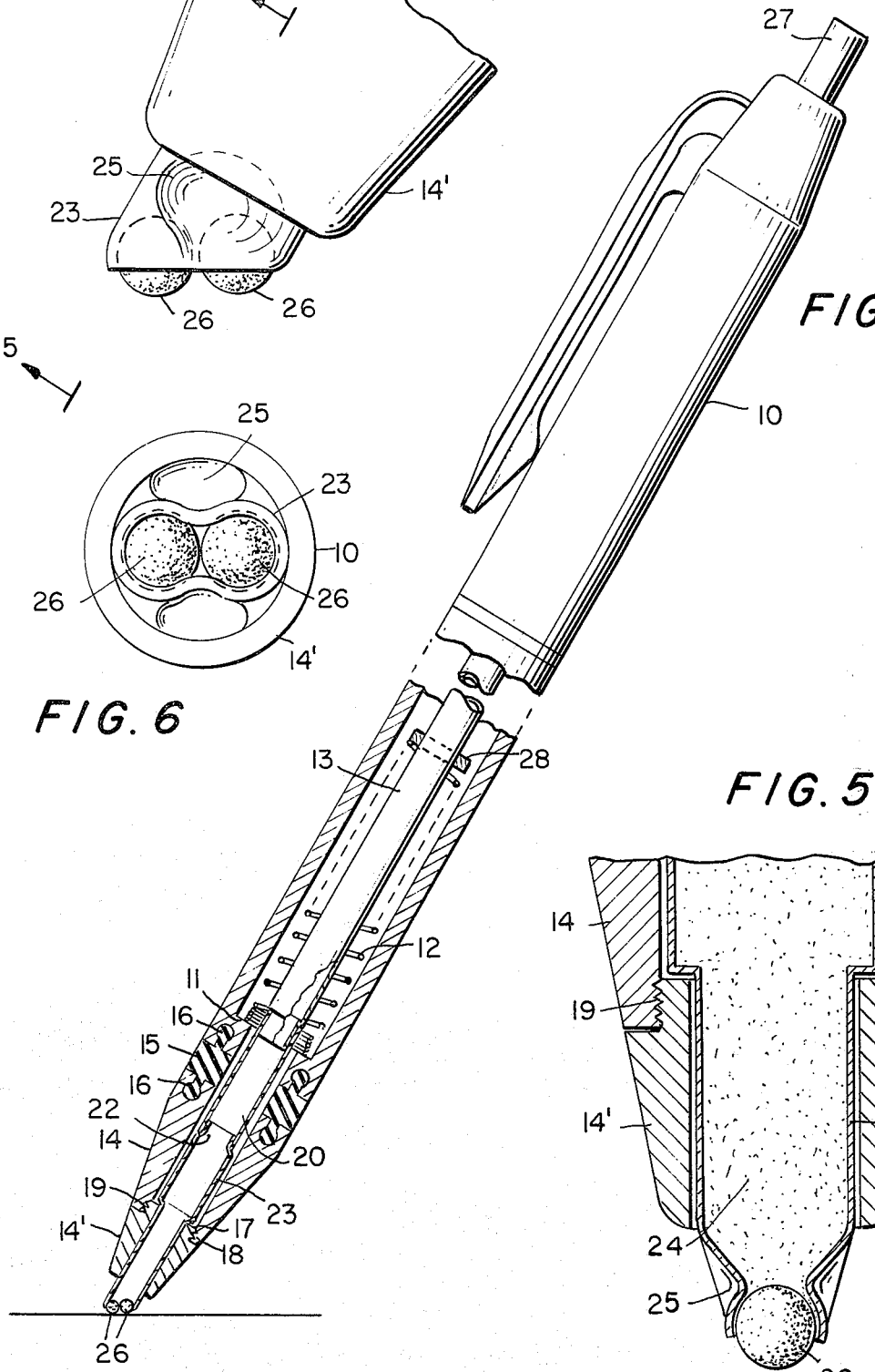
FIG. 1
FIG. 5
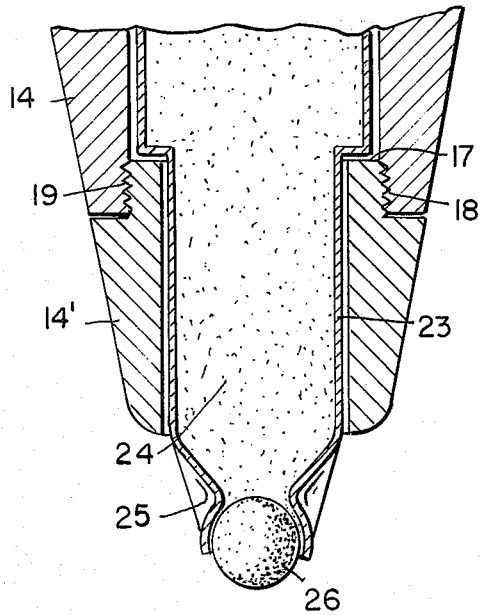

FIG. 2
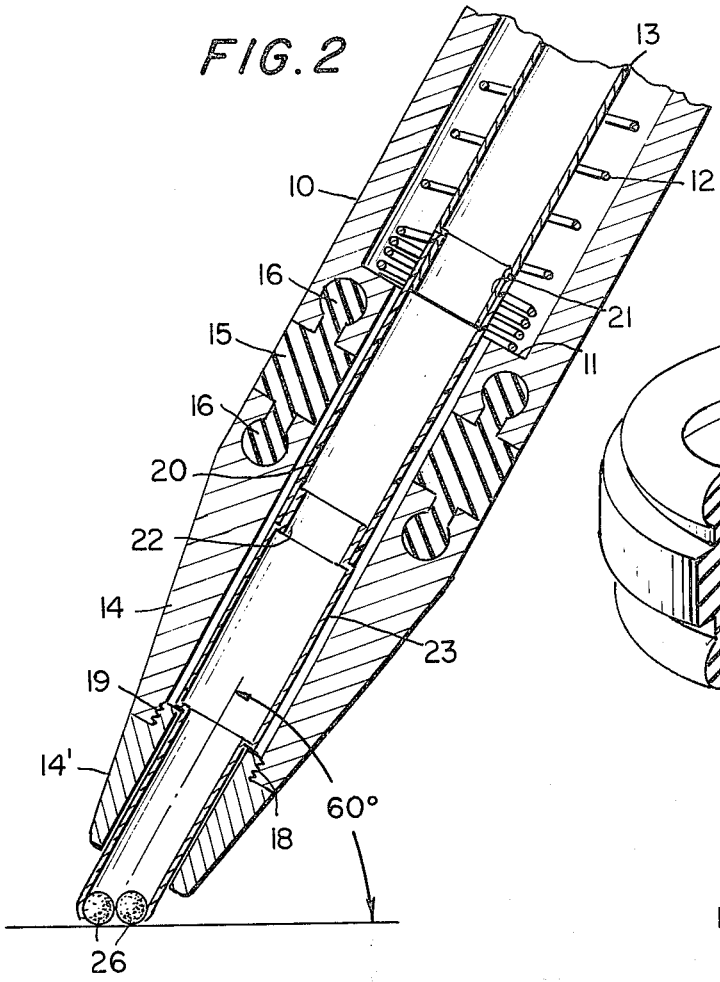
FIG. 7
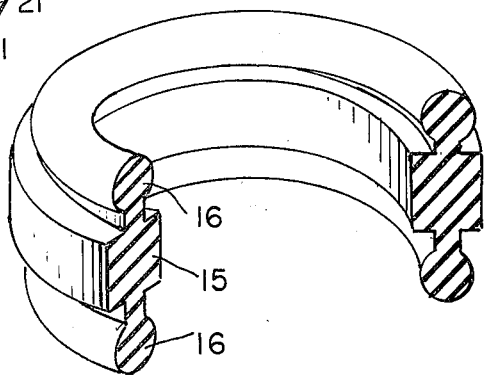
FIG. 8
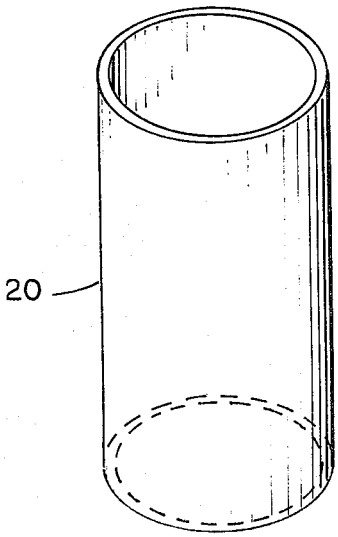
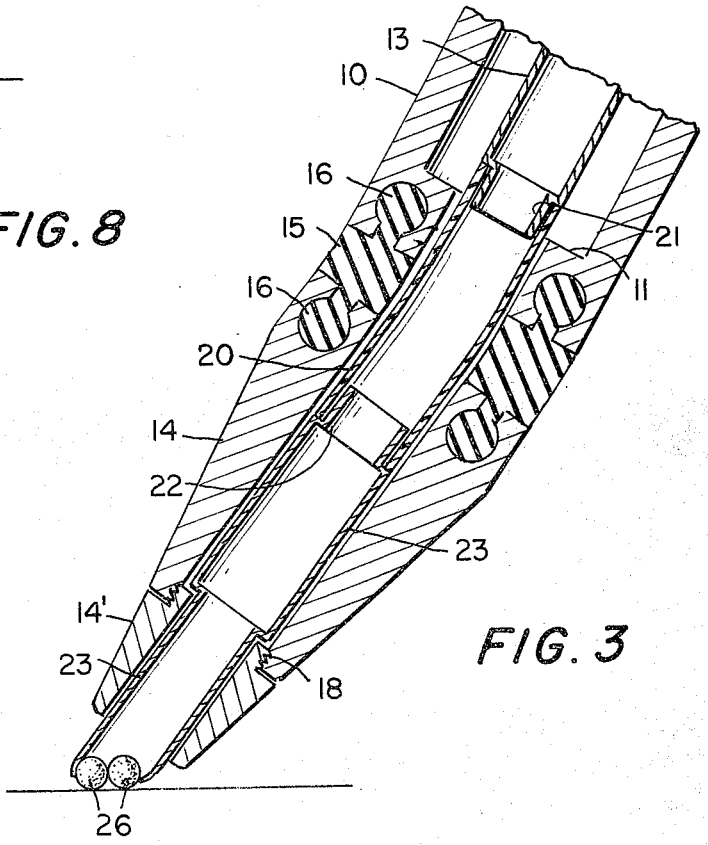
FIG. 3

FLEXIBLE DOUBLE BALL-POINT PEN

THE PRESENT INVENTION

This invention relates to a ball-point pen specially constructed to permit writing of characters and lines of different thicknesses and styles while changing the style of writing at will. The pen is particularly adapted for writing in languages having ideographic characters such as Arabic, Hebrew and Oriental languages. The pen is provided with a flexible joint of compressible and expandable material responsive to the amount of pressure and direction of movement of the user's hand and further with a pair of ball-point balls in communication with an ink supply of a composition conventionally used in ball-point pens and wherein the pair of ball-point balls is held in contact by an inwardly bent dimple formation in an ink-containing tube at the writing end of the pen. In other respects the ball-point pen is of standard or conventional construction.

In the accompanying drawing,

FIG. 1 is a vertical section partly in elevation of a pen according to the present invention;

FIG. 2 is an enlarged fragmentary sectional view of the writing end of the pen of FIG. 1;

FIG. 3 is a schematic view of FIG. 2 and illustrating how the pen is capable of flexing;

FIG. 4 is an enlarged view of the lowermost portion of the pen showing the pair of ball-point balls and the dimple formation;

FIG. 5 is a sectional view taken on line 5 — 5 of FIG. 4;

FIG. 6 is an underside view of FIG. 4; and

FIGS. 7 and 8 are respectively enlarged detail views of the ring which permits the flexing action and the flexible tube which holds the surrounding sections together.

Referring to the drawing, the numeral 10 designates the conventional ball-point pen hollow cylindrical body portion of a ball-point pen and which body portion terminates in an inturned annular flange 11 forming a seat against which helical spring 12 seats, said spring encircling the rod 13 extending axially of the hollow cylindrical body portion 10. The pen also comprises a tapering portion 14 forming an extension of the cylindrical portion 10 and longitudinally spaced therefrom. A ring 15 of rubber or other suitable material is inserted between the inturned flange 11 of the body portion 10 and the said tapering portion 14 and this ring 15 has bulbous extensions 16 fitted into complementary recesses in the adjacent portions as shown. Beyond the tapering portion 14 is a tapering metal heel extension portion 14' having a reduced upper end 17 externally threaded at 18 for threadedly engaging the inner lowermost threaded surface 19 of said tapered portion.

A tubular member 20 made of plastic or other suitable material capable of flexing with the expansion and contraction of ring 15 is disposed interiorly of the tapered portion 14 and extends upwardly for reception of the lowermost reduced end 21 of rod 13 and at its opposite end receiving the reduced upper end 22 of metal sleeve 23 which is adapted to be filled with ink as at 24 of FIG. 5 of the usual composition employed in ball-point pens. This metal sleeve 23 terminates in a dimpled portion 25 which, as more clearly shown in FIG. 5, constitutes a deformation or crimping of the lower end of the metal sleeve 23 to hold the pair of hammered or other usual ball-point balls 26 in contact with one another while preventing them from becoming disassembled from the tube 23 which is surrounded near its lower end with a metal heel 14'.

By virtue of the construction illustrated and described, it will be understood that the pen is capable of flexing at the ring 15 and this appears more clearly in FIG. 3 where the pen portions are out of alignment due to compressive pressure on one side and comparable expansion on the other side. This enables the pair of ball-point balls to write or mark on any desired surface and in any desired type of line or ideograph ranging from a very thin line to a very wide line with changes able to be made at the will of the user. The pen is also particularly well suited for use by artists and architects, as it is capable of making a wide variety of lettering and characters.

It will be understood further that the pen is activated and inactivated in usual manner by exerting axial pressure on projecting button or knob 27 which causes the rod member 13 of the pen to project the ball-point balls 26 into writing position and then a further actuation thereof causes the writing portion to retract in known manner under the control of rod 13 and helical spring 12 the upper end of which abuts washer 28 fixed on rod 13. It is understood that the foregoing is illustrative and not limitative and while it represents the presently best known mode of carrying out the invention, variations in size, proportions and materials may be made without departing from the invention. It is deemed particularly important that in use and to obtain optimum results, the pen of the invention be normally held at an angle of 60° to the writing surface as indicated on the drawing as this permits the double ball arrangement to draw ink and transfer it to the surface to be written upon in a smooth and easy manner while providing maximum maneuverability for writing, drawing or marking purposes with lines of desired fineness or broadness and with the ability to change the lines being made at will.

What is claimed is:

1. A flexible double ball-point pen comprising an aligned body portion and writing portion, the body portion and writing portion being constructed to be movable out of alignment by flexing in response to pressure and direction of movement of a user's hand by an intermediate ring of compressible and expandable flexible material interfitted between and connected into the body portion and writing portion by means of oppositely extending projections on said ring which fit into complementary recesses in the body portion and writing portion and the writing portion having a pair of ball-point balls held together against disassembly in a sleeve at the lower end of the writing portion and said sleeve being provided with a supply of ink.

2. A flexible double ball-point pen according to claim 1 adapted to flex near its writing end responsive to writing pressures of the user comprising a hollow cylindrical body portion terminating in an inturned flange forming a seat, a spring-urged rod disposed axially within said body portion and actuatable to active and inactive positions by a helical spring encircling the rod adjacent the flange and seated thereon, a tapering tubular portion having a wall forming an extension of the body portion and spaced therefrom, an annular compressible and expandable ring in the space between the body portion and the adjacent end of the tapering tubular portion and having bulbous extensions fitted into complementary recesses in said body portion flange and tapering tubular portion wall, a flexible tubular sleeve disposed axially to the rod and extending beyond the body portion flange beyond the ring and having a bore of an internal diameter to receive an end of said rod upon compression of the helical spring and to permit retraction of said rod, a metal ink-receiving tube arranged as an extension of the sleeve and having a portion of reduced diameter in one end of said sleeve, ball-point ink composition in the tube, an extension of the tube of reduced diameter forming a shoulder, a pair of ball-point balls held in the lower end of the tube and adapted to contact a surface on which the pen is intended to write and a metal heel threadedly engaging the inner lower end of the tapering tubular portion and extending around the tube extension downwardly toward but terminating short of said ball-point balls with its upper externally threaded portion forming a support for the tubular extension shoulder, and means for compressing said helical spring to project said ball-point balls into position for writing.

3. A ball-point pen according to claim 2 wherein the ring and its bulbous extensions are composed of rubber.

4. A ball-point pen according to claim 3 wherein the flexible tubular sleeve is composed of plastic capable of flexing.

* * * * *